US010605028B2

(12) United States Patent
Boge

(10) Patent No.: US 10,605,028 B2
(45) Date of Patent: Mar. 31, 2020

(54) METHOD OF REMOVING EQUIPMENT FROM A SECTION OF A WELLBORE AND RELATED APPARATUS

(71) Applicant: Qinterra Technologies AS, Stavanger (NO)

(72) Inventor: Erik Boge, Egersund (NO)

(73) Assignee: Qinterra Technologies AS, Stavanger (NO)

( * ) Notice: Subject to any disclaimer, the term of this patent is extended or adjusted under 35 U.S.C. 154(b) by 150 days.

(21) Appl. No.: 15/740,635

(22) PCT Filed: Jun. 24, 2016

(86) PCT No.: PCT/NO2016/050138
§ 371 (c)(1),
(2) Date: Dec. 28, 2017

(87) PCT Pub. No.: WO2017/007331
PCT Pub. Date: Jan. 12, 2017

(65) Prior Publication Data

US 2018/0187504 A1 Jul. 5, 2018

(30) Foreign Application Priority Data

Jul. 3, 2015 (NO) ..... 20150865

(51) Int. Cl.
*E21B 31/20* (2006.01)
*E21B 23/14* (2006.01)
(Continued)

(52) U.S. Cl.
CPC ..... *E21B 31/20* (2013.01); *E21B 23/14* (2013.01); *E21B 47/09* (2013.01); *E21B 2023/008* (2013.01)

(58) Field of Classification Search
CPC ..... E21B 31/00; E21B 31/18; E21B 31/12; E21B 31/125; E21B 31/14; E21B 31/20;
(Continued)

(56) References Cited

U.S. PATENT DOCUMENTS

2005/0072577 A1* 4/2005 Freeman ..... E21B 34/14 166/386
2005/0145415 A1* 7/2005 Doering ..... E21B 4/18 175/24

(Continued)

FOREIGN PATENT DOCUMENTS

EP 2599952 A1 6/2013
EP 2884044 A1 6/2015
WO 2010123375 A1 10/2010

*Primary Examiner* — David Carroll
(74) *Attorney, Agent, or Firm* — Gable Gotwals

(57) ABSTRACT

There is described a method of removing equipment from a section of a wellbore, and related apparatus. In embodiments of the invention a tool string (10) is provided having a tractor (15) and a GS-pulling tool (14). The tool string (10) is run into the wellbore using the tractor (15), at least one section of the tractor being positioned ahead of the GS-pulling tool (14) within the tool string (10), and the GS-pulling tool (14) is used to couple the equipment (12) to the tool string (10), for allowing the equipment (12) to be removed.

15 Claims, 5 Drawing Sheets

(51) Int. Cl.
*E21B 47/09* (2012.01)
*E21B 23/00* (2006.01)

(58) Field of Classification Search
CPC .... E21B 47/09; E21B 2023/008; E21B 29/00; E21B 29/002; E21B 29/005; E21B 29/02
See application file for complete search history.

(56) References Cited

U.S. PATENT DOCUMENTS

2010/0263856 A1* 10/2010 Lynde ..... E21B 23/14
166/53
2012/0037358 A1* 2/2012 Ferkingstad ..... E21B 4/18
166/241.6

* cited by examiner

- PRIOR ART -

METHOD OF REMOVING EQUIPMENT FROM A SECTION OF A WELLBORE AND RELATED APPARATUS

CROSS-REFERENCE TO RELATED APPLICATIONS

This United States application is the National Phase of PCT Application No. PCT/NO2016/050138 filed 24 Jun. 2016, which claims priority to Norwegian Patent Application No. 20150865 filed 3 Jul. 1 Apr. 2015, each of which is incorporated herein by reference.

BACKGROUND OF THE INVENTION

Technical Field

The present invention relates to the removal of equipment in wells. In particular, it relates to removing equipment such as a straddle from a section of a wellbore using a tool string equipped with a tractor and an engaging tool such as a GS-pulling tool.

Background

In the oil and gas exploration and production industry, wellbore operations such as well intervention operations may be performed at various times during the life of a well, e.g. for performing maintenance or repair, e.g. so that the well can continue to produce oil and gas. In some cases, it is necessary to pull out equipment or objects that have been installed in the well, and a tool string may be provided for this purpose. In the case of pulling out equipment in the form of a tubular object such as straddle in a deviated portion of a wellbore, a standard tool string is typically used as indicated in FIG. 1.

As seen in FIG. 1, the standard tool string is arranged to be provided on a wireline W and includes components comprising (in succession away from the wireline W toward the head of the string) a cable head 1, a swivel 2, a casing collar locator (CCL) 6, a wireline tractor 5, a stroker 3, a release sub system (RSS) 7, and a pulling tool in the form of a GS-pulling tool 4. Such a tool string may be deployed from an intervention vessel, using the tractor 5 to help to move the tool string into and along the wellbore to the location of the straddle. The GS-pulling tool 4 is positioned at the end of the stroker 3 where it is operated to connect the straddle to the tool string. The stroker 3 is used to dislodge and loosen the straddle from its installation location. Then the tool string with the straddle attached is transported out of the wellbore by spooling in the wireline W.

The total length of the combined string including the tool string and the removal object can be significant, such that there can be practical challenges in the process of recovering the object. In many cases, there may not be sufficient space available for accommodating strings or objects above a certain size or length. In recovering a string for example, it is common to move the string into a sluice, often termed a "lubricator", for isolating the string safely from the well before the sluice, together with string, can be removed onto deck and disassembled. The sluice is typically isolated from the well with a valve, allowing the sluice with the string contained therein to be depressurized and fluid from the well to be drained out. However, the total length capacity of the sluice can be a significant limitation on the total length of the string that can be accommodated. Many prospective operations may not be feasible using a given vessel or platform, depending upon the sluice capacity. For example, it may be desirable to carry out such an operation from a light intervention vessel with a view to limiting costs. However, such vessels may only be able to handle sluices and tool strings of limited size or limited total length capacity. Thus, if the total length of the combined string exceeds sluice capacity, the operation may need to be assigned to a different vessel or platform, or a different sluice, e.g. a re-designed sluice, which may increase cost, logistics and/or operational complexity.

Sluices typically have a capacity for accommodating total lengths of up to around 22 m, whilst the typical tool string for performing a pulling operation (such as that of FIG. 1), can be around 13 to 14 m, taking up a similar length within the sluice during the retrieval of the object. Space problems in the sluice have typically been attributed to the length of the tool string or the size of the sluice itself.

SUMMARY OF THE INVENTION

According to a first aspect of the invention, there is provided a method of removing equipment from a section of a wellbore, the method comprising the steps of:

(a) providing a tool string comprising a tractor and an engaging tool;

(b) running the tool string into the wellbore using the tractor, at least one section of the tractor being positioned ahead of the engaging tool within the tool string; and (c) using the engaging tool to couple the equipment to the tool string, for allowing the equipment to be removed.

The equipment may comprise a tubular structure, such as for example a section of lining or casing. The equipment may be installed within well tubing, e.g. temporarily. The tubular structure may be configured to isolate sections of the wellbore, e.g. perforated sections of the wellbore tubing. The tubular structure may be configured to and/or to prevent, hinder or restrict fluid leakage into an annulus behind the well tubing, and/or to prevent, hinder or restrict inflow from the annulus into wellbore. The tubular structure may comprise a section of tubing in the form of a straddle. The equipment may comprise a straddle. The straddle may comprise a section of pipe or a sleeve. The straddle may be provided with any one or more of: a sliding sleeve; a side-pocket mandrel (SPM); instruments for making measurements; a valve for controlling production; tracer material; and corrosion resistant material. The straddle may protect parts or components in the well, which may be susceptible to weakening, or damage. For example, the straddle may provide corrosion protection. The straddle may typically have a length in the range of 5 to 20 m.

The method may further comprise moving said section of the tractor into the tubular structure, e.g. the straddle.

The engaging tool may comprise a pulling tool, which may preferably be a GS-pulling tool.

The equipment may preferably be configured to be engaged by the engaging tool to couple the equipment to the tool string. Accordingly, the method may further comprise engaging the equipment using the engaging tool. The equipment may be provided with at least one formation or profile which may be engaged by the engaging tool or a member thereof.

The engaging tool may typically have a member, such as a dog or a gripper, arranged 2 to engage the equipment, for example to grip onto and/or interlock with the equipment, or said formation or profile.

The profile may comprise a profile which is configured to receive an engaging member of the engaging tool in a complementary fit such that the engaging member when received by the profile interlocks with the profile. In this way, a connection between the equipment and the tool string may be provided whereby the equipment can be securely attached to the tool string.

In the case of the equipment comprising a tubular structure such as a straddle, the engaging formation or profile may comprise for example a groove, or recess, or the like, and may be provided on an inner surface of the tubular structure. Typically the engaging formation may be provided at or near an end of the structure. The engaging member of the tool may comprise an outwardly protruding member, which may for example be received in said groove or recess or the like.

The method may further comprise bringing the engaging tool alongside the equipment, or the formation or profile thereof, for engaging the equipment using the engaging tool. The equipment may be engaged by inserting the engaging tool into the equipment, in embodiments where the equipment comprises a tubular section. The method may include positioning the engaging tool such that an engaging member is aligned with the equipment, or the formation or profile thereof, to allow the engaging member to move into engagement therewith.

The method may further comprise recovering, e.g. pulling out, the coupled tool string and equipment from the wellbore. The tool string may typically be recovered using a flexible elongate member coupled to the tool string, e.g. by spooling in the flexible elongate member. The flexible elongate member may comprise a wireline, cable, coiled tubing or the like. The flexible elongate member may typically be configured for connecting the tool string with a surface facility e.g. winch facility, e.g. on a vessel.

The method may further comprise locating the coupled tool string and equipment in a sluice. The sluice may typically be provided at the seabed, e.g. deployed from a well intervention ship onto a wellhead.

Preferably, the tool string may further comprise any one or more of: an actuator for activating the engaging tool and/or dislodging the equipment; a locator device for use in determining the position of the tool string within the wellbore; a connecting head for attaching the tool string on a flexible elongate member; a release device, such as a release sub system (RSS); and a swivel for limiting torque on any of the flexible elongate member, the tool string or a component thereof.

The actuator may typically comprise a stroker, for example a bi-directional stroker. The stroker may be configured to generate movement axially to dislodge the equipment. The stroker may be configured to generate movement of the engaging tool along the wellbore and/or the tool string, e.g. laterally, once the engaging tool is interconnected with the equipment. The locator device may typically comprise a casing collar locator.

The tool string may further comprise a casing collar locator. The casing collar locator may be arranged within the tool string ahead of the engaging tool. The casing collar locator may be arranged within the tool string ahead of said section of the tractor. The position of the casing collar locator may depend upon the actual length. For instance, the casing collar locator could be placed closer to the swivel, but for saving length, placement in front of the engaging tool may be preferred.

Said section of the tractor may preferably comprise at least one drive wheel for propelling the tool string along the wellbore. The tractor may be arranged substantially entirely ahead of the engaging tool within the tool string.

The tool string may be a well intervention work string.

According to a second aspect of the invention, there is provided a tool string for use in removing equipment from a section of the wellbore, the tool string comprising a tractor and an engaging tool and being configured to be run into the wellbore having at least one section of the tractor positioned ahead of the engaging tool.

According to a third aspect of the invention, there is provided an engaging tool for use in the method of the first aspect and/or the tool string of the second aspect.

The engaging tool may be further configured to communicate electrical energy between an electrical supply and said section of the tractor ahead of the tool, for operating the tractor. The engaging tool may be a GS-pulling tool.

According to a fourth aspect of the invention there is provided a method of removing equipment from a section of a wellbore, the method comprising the steps of:

(a) providing a tool string comprising a tractor;
(b) running the tool string into the wellbore using the tractor; and
(c) coupling the equipment to a part of the tool string uphole from at least one section of the tractor, for allowing the equipment to be removed.

The tool string may typically include an engaging tool. The method may include using the engaging tool to couple the equipment to the tool string. The engaging tool may be positioned uphole within the tool string with respect to at least one section of the tractor.

According to a fifth aspect of the invention there is provided a tool string for use in the method of the fourth aspect.

According to a sixth aspect of the invention, there is provided a well in which equipment has been removed by performing the method of any of the aspects, or using the tool string and/or the engaging tool of any of the aspects of the invention.

It can be noted that the terms "uphole" and "downhole" are used herein for indicating relative position along the wellbore trajectory, toward or away from the well head along the wellbore, and do not signify any particular elevation. Accordingly, the term "uphole" can be indicative of a position in that is closer to the well head along the wellbore path than another position, but which is of the same elevation, such as for example may be the case in horizontal wellbore sections. Conversely, the term "downhole" can be indicative of a position that is a greater distance away from the wellhead along the wellbore path than another, but which has the same elevation.

Any of the aspects of the invention may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Embodiments of the invention are advantageous in various ways as will be apparent from the specification throughout.

DRAWINGS AND DESCRIPTION

There will now be described, by way of example only, embodiments of the invention with reference to the accompanying drawings, in which.

Figure 1:
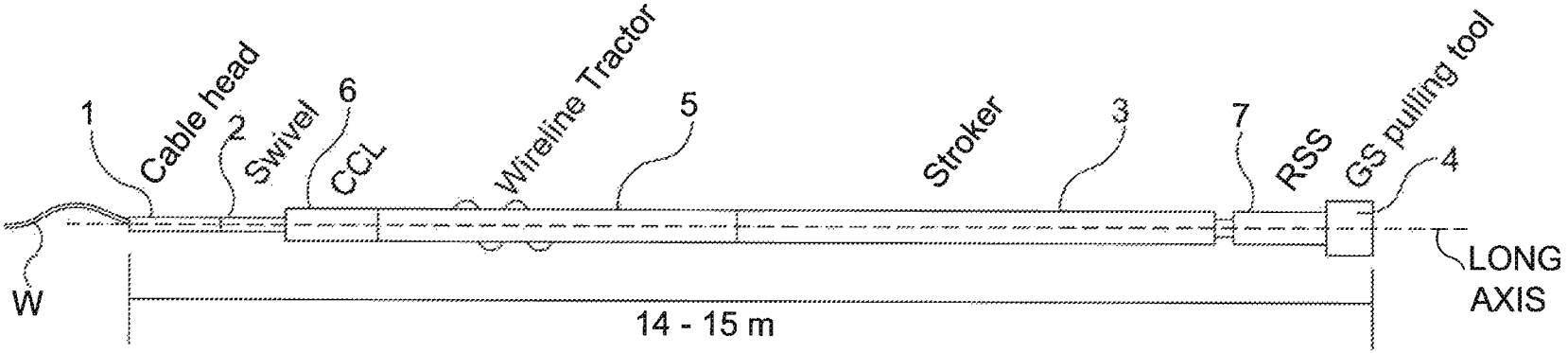
FIG. 1 is a schematic side view of a standard prior art tool string for pulling out equipment from a well.
Figure 2:
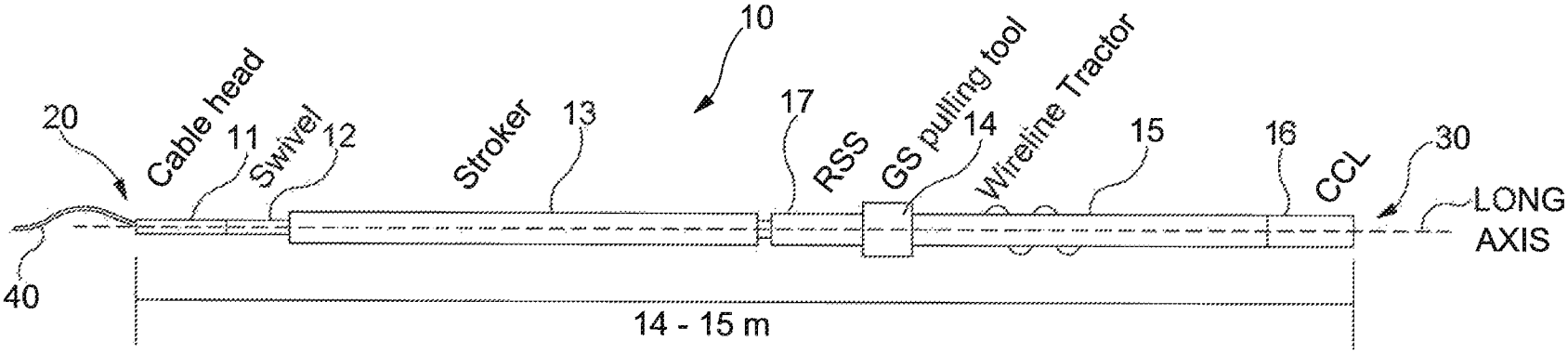
FIG. 2 is a schematic side view of a tool string for pulling out equipment from a well, according to an embodiment of the invention.
Figure 3:
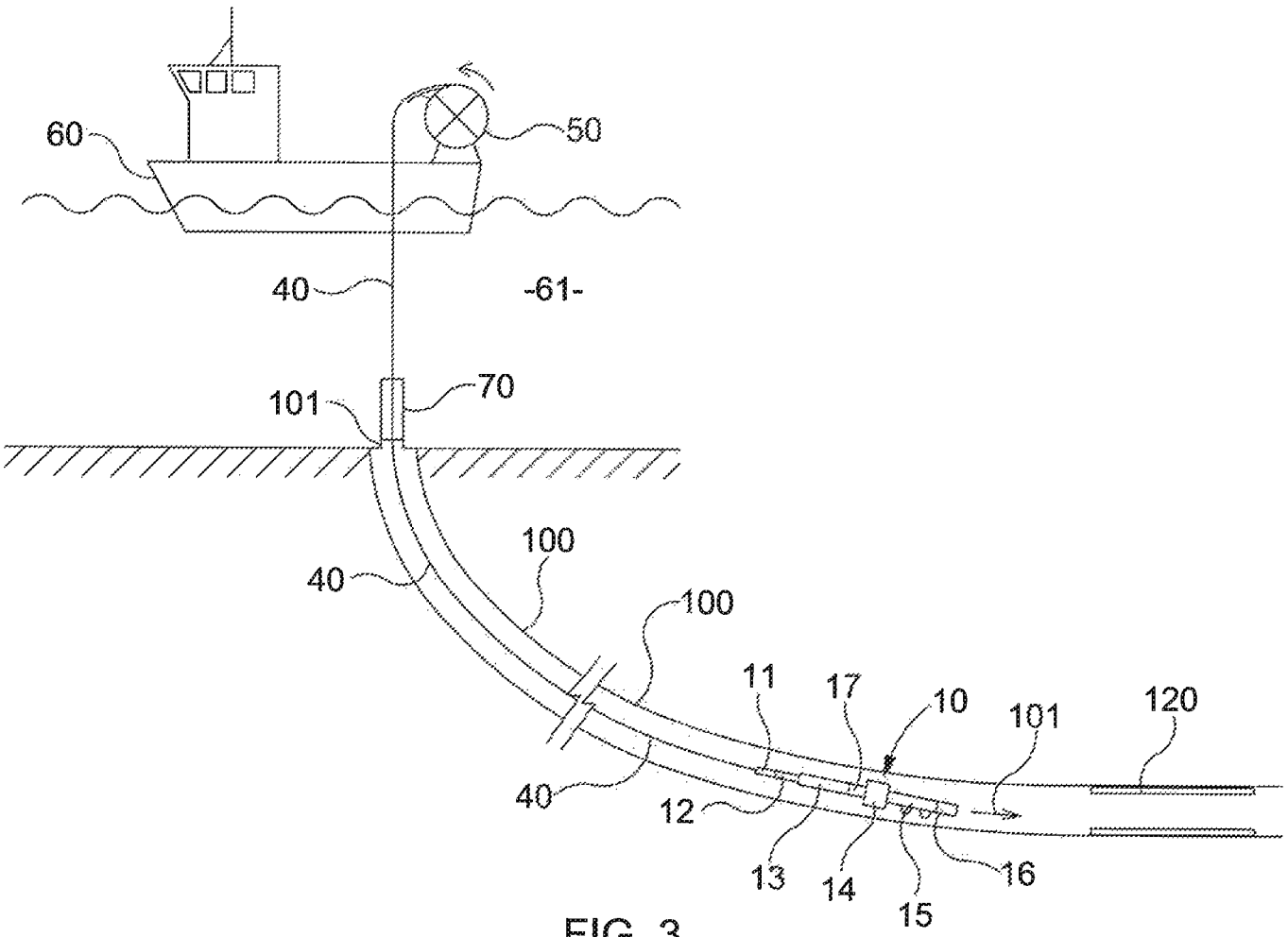
FIG. 3 is a schematic representation in smaller scale showing the tool string of FIG. 2 during run-in into a wellbore in a pulling operation for pulling out a straddle, according to an embodiment of the invention.
Figure 4:
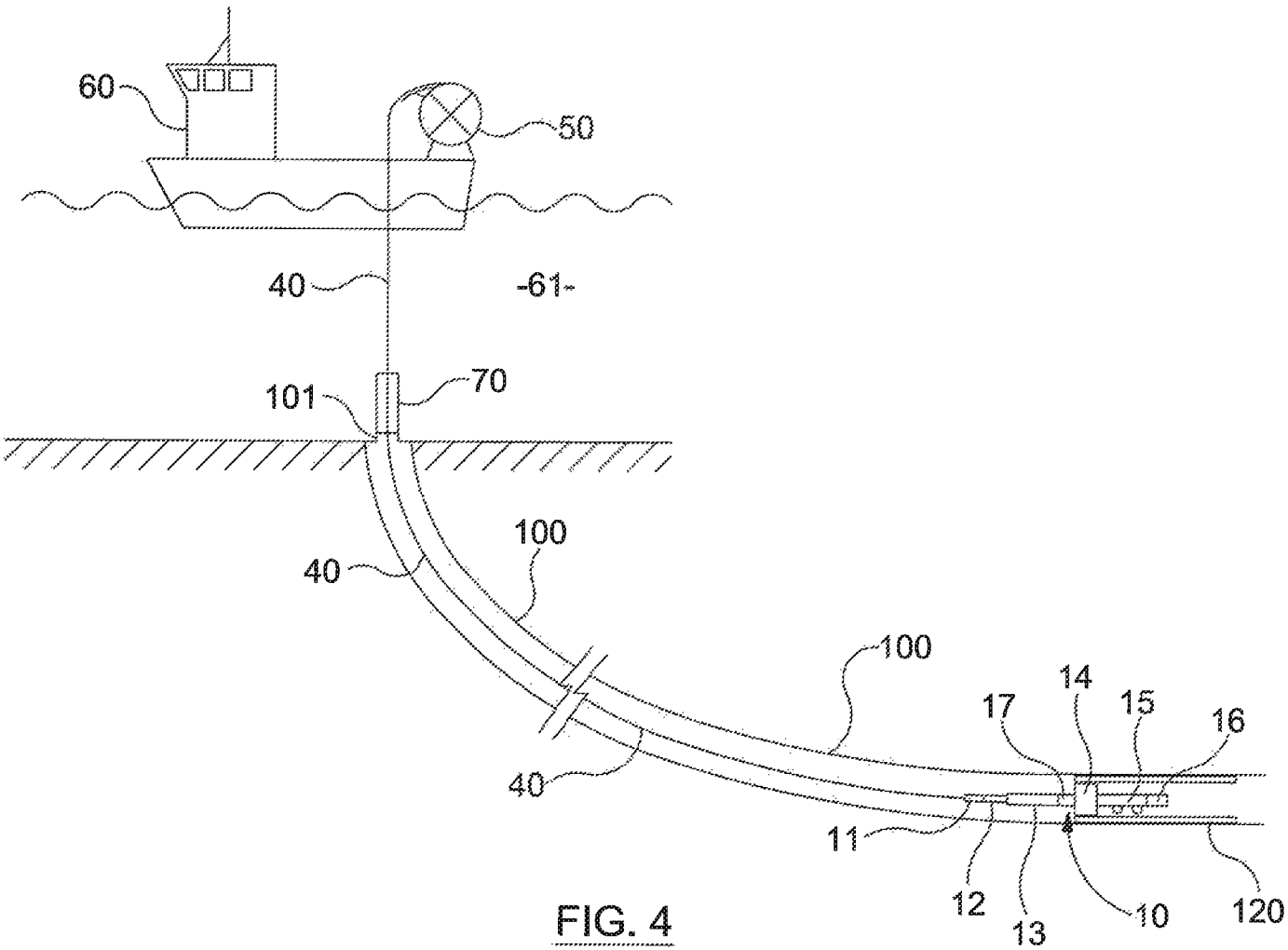
FIG. 4 is a schematic representation showing the tool string of FIG. 2 in a subsequent position during the operation of FIG. 3, showing the pulling tool positioned in proximity to the straddle.
Figure 5:
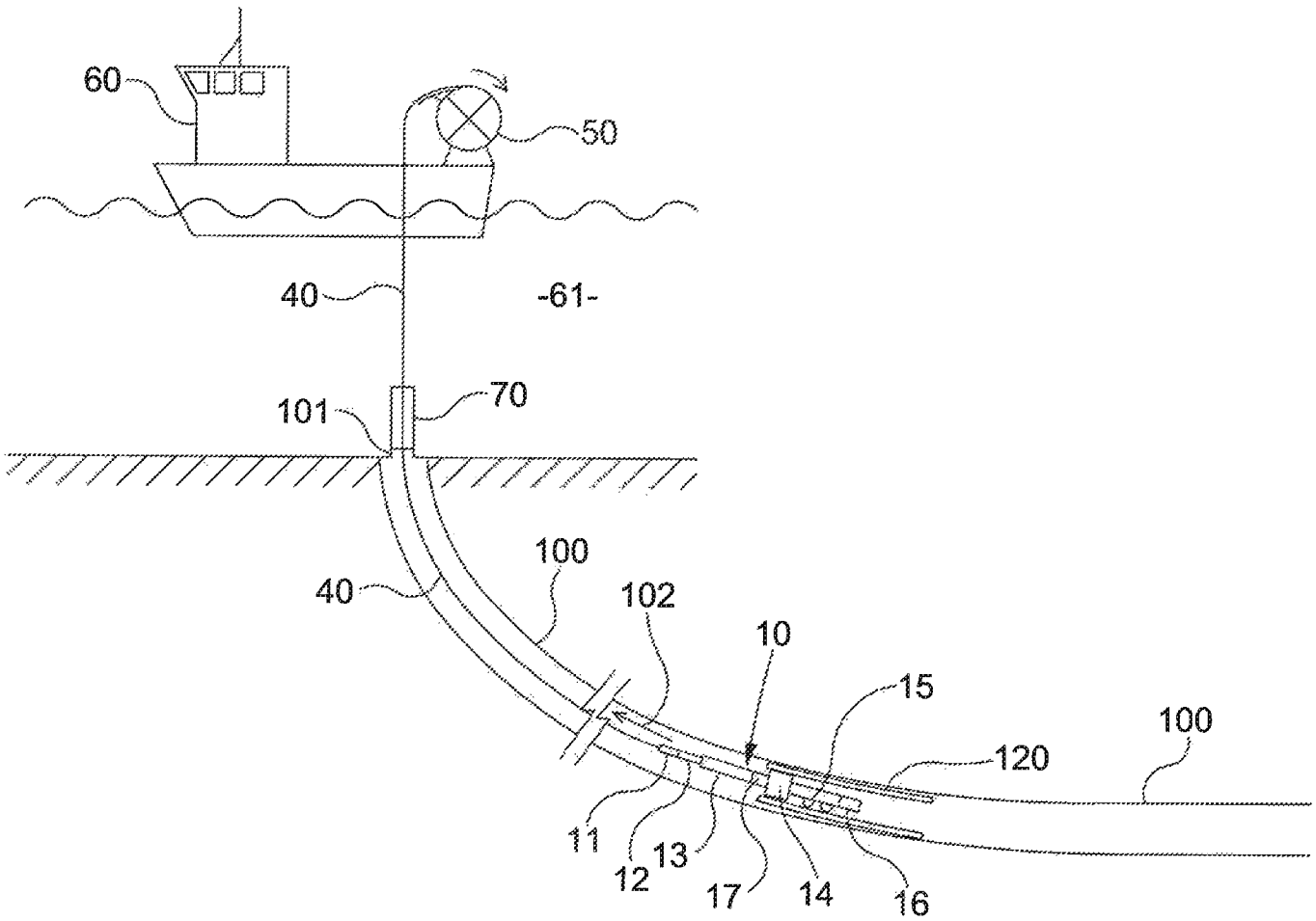
Figure 6:
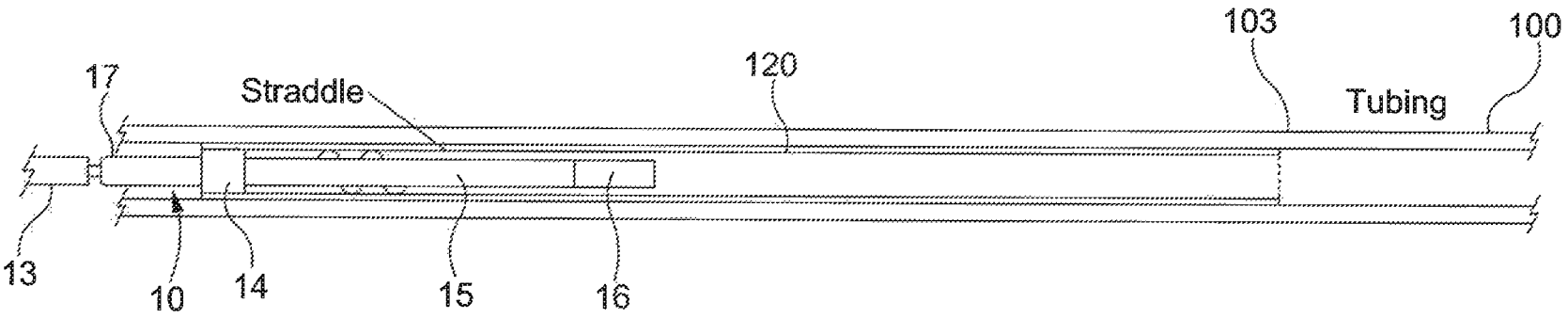

FIG. 5 is a schematic representation showing the tool string of FIG. 2 in a yet further subsequent position during the operation of FIG. 3, during transport of the straddle out of the wellbore toward the surface; and FIG. 6 is a cut-away side representation of the tool string of FIG. 2 in larger scale showing the pulling tool positioned in proximity to the straddle, in larger scale than that shown in FIG. 4.

In FIG. 2, a tool string 10 for pulling out equipment from a wellbore (not shown) is depicted. The tool string 10 has a first end 20 at a tail of the tool string 10, and second end 30 at the head of the tool string 10. The tool string 10 includes, in succession toward the head of the tool string 10: a cable head 11; a swivel 12; a stroker 13; a release device 17; a GS-pulling tool 14; a tractor 15; and a casing collar locator (CCL) 16. These components are configured for pulling out equipment from a deviated section of a well.

In particular, as can be seen in FIG. 2, a section of the tractor 15 is positioned ahead of the GS-pulling tool 14. Thus, a section of the GS-pulling tool 14 assumes a position behind the tractor 15. In this way, the GS-pulling tool 14 is positioned such that it can engage with the equipment closer to the first end 20 than in prior art tool strings. Therefore, once the GS-pulling tool 14 is activated and the equipment is coupled to the tool string 10 via the GS-pulling tool 14, a reduction in the overall length of the tool string 10 and the equipment may be achieved, or equipment may be pulled out from the well that has a greater length for a given overall length limit, than has previously been possible by use of prior art tool strings.

A wireline 40 is connected to the tool string 10 at the cable head 11. The swivel 12 is used for mitigating torque transmission between the wireline 40 and far end components within the tool string 10. The GS-pulling tool 14 is configured in an active position through shear pins which hold the GS-pulling tool 14 in the active position. In the active position, the GS puling tool 14 is configured to connect with the equipment. The shear pins can be sheared when needed, so that the GS-pulling tool 14 is released from the equipment. Furthermore, the stroker 13 can be applied to move the GS-pulling tool 14 back and forth axially along the tool string, once the GS-pulling tool 14 is connected with the equipment, in order to help dislodge or loosen the equipment to be pulled out. The tractor 15 operates to facilitate propulsion of the tool string 10 along deviated portions of the wellbore. The tractor 15 is supplied with electrical and/or hydraulic power by running suitable lines through the GS-pulling tool 11. The casing collar locator 16 is provided farthest toward the second end 30 and is used to obtain casing collar data for determining the position of the tool string relative to the wellbore upon deployment. The position of the casing collar locator 16 within the tool string 10 means that the casing collar locator 16, in addition to the tractor 15, does not contribute to the length along the tool string 10 between the cable head 11 and the GS-pulling tool 14. This helps to further minimize the total length of the tool string 10 and the connected equipment.

The release device 17 can take the form of a release sub system (RSS) and is provided to disconnect part of the tool string 10 from the wireline 40 if required, for example in the event of a stuck tool or equipment in the wellbore or other problem. In this example, the release device 17 is positioned between the GS-pulling tool 14 and the stroker 13, such that upon activation of the release device 17, a portion of the tool string 10 including the GS-pulling tool 14, the wireline tractor 15 and the casing collar locator 16, on the downhole side of the release device, would be disconnected from the tool string 10. The release device 17 can be activated through an operator signal delivered from the surface via the wireline 40, or can activate automatically in the event of failures in other components of the tool string 10, such as failure of communications or power from the surface. In this way, the release device 17 can help to free the wireline if the tool string or equipment attached thereto get stuck in the wellbore.

While the release device 17 may be placed elsewhere in the tool string 10 between the swivel 12 and the casing collar locator 16, for example between the stroker 13 and the casing collar locator 16, it is typically preferable for it to be placed, as shown, between the stroker 13 and the GS-pulling tool 14, as this allows the GS-pulling tool 14 with the equipment attached to be released, whilst allowing a substantial part of the tool string, on the uphole side of the release device 17, to be freed and retrieved along with the wireline.

It will be appreciated that the tool string 10 is configured to be used in the wellbore with the first end 20 arranged uphole and the second end 30 arranged downhole with respect to one another.

With reference now to FIGS. 3 to 5, the tool string 10 is shown during use in a sub-surface wellbore 100 in an operation for removing equipment in the form of a straddle 120 from a section of the wellbore 100.

The straddle 120 comprises a section of pipe and is installed within tubing in the well-go bore 100. Such a straddle can be installed on a temporary basis and may be removed when desired, e.g. if no longer required. The straddle may be installed so as to line and/or cover over part of the tubing. In production tubing, the straddle may be used for example to cover perforations in the wall of the tubing, so as to block fluid communication through the perforations with the internal bore of the wellbore.

In FIG. 3, the tool string 10 is being run-in, moving downhole toward a far reach of the wellbore 100, as indicated by the arrow 101. In the position shown in FIG. 3, the tool string 10 is approaching the straddle 120 in a deviated, near-horizontal, section of the wellbore 100.

The tool string is deployed from a sluice 70 which is connected to a subsea well head 101. The tool string 10 is temporarily accommodated inside the sluice 70 before the tool string 10 is moved out of the sluice 70 and inserted into the wellbore 100. In order to install the sluice 70, the sluice 70, together with the tool string 10 contained therein, is lowered from an intervention vessel 60 onto the wellhead 101 at the seabed and is then connected.

The tractor 15 is positioned ahead of the pulling tool 14 and is being used to facilitate the movement of the tool string 10 along the wellbore 100. The tractor 15 has drive wheels which engage against the wall of the wellbore 100 to generate traction for driving the tractor 15 along the wellbore 100. The tractor 15 acts to pull the GS-pulling tool 14 into proximity to the straddle 120 so that the straddle 120 can be connected to the tool string 10 using the GS-pulling tool 14. The wireline 40 is spooled out from a wireline winch unit 50 on the intervention ship 60 in the sea 61 at the Earth's surface. In FIG. 4, the tool string 10 has arrived at the location of the straddle 120 in the wellbore 100. The tractor 15 is driven into the straddle 120, to bring the GS-pulling tool 14 into position for engaging with the straddle 120. The GS-pulling tool 14 is configured to engage with a matching profile on the straddle 120, so that the straddle 120 interlocks with the GS-pulling tool 14 upon engagement. The GS-pulling tool 14 has dogs (not shown) and an internal spring mechanism (not shown) which pushes on the dogs so that they can interlock with the matching profile. The dogs are urged by the spring mechanism into an active position in which they interlock with the matching profile.

It can be noted that although the dogs are in general set in the active position, they can be retracted if required, allowing the tool string to be released from the equipment. For example, by hammering downwards, or by applying a sufficiently high force using the stroker 13, the shear pins in the GS pulling tool 14 can be broken such the spring mechanism operates to cause the dogs to retract from the active position.

The stroker 13 is applied to dislodge the straddle 120, freeing the straddle 120 to allow the straddle 120 to be removed and pulled out of the wellbore 100 together with the tool string 10. When releasing and pulling the straddle 120, the stroker 13 is anchored in tubing in the wellbore, and acts to apply bi-directional force on the straddle, in opposing directions back and forth along the tubing. This may include imparting a pulling force on the straddle 120 for pulling on the straddle 120 for releasing the straddle 120. Similarly, a pushing force may be imparted. In the event of complications occurring during the operation, for example, it may be sought to release the tool string 10 from the straddle 120, in which case the stroker 13 can be anchored and used to impart a downward push force to shear the shear pins inside the GS-pulling tool 14 to release the tool string 10 from the straddle 120.

In FIG. 5, the tool string 10 is being transported uphole out of the wellbore, away from the far reach of the wellbore 100 as indicated by the arrow 102. The straddle 120 is attached to the tool string 10 by the interlocking connection formed with the GS-pulling tool 14. The combined string including the tool string 10 and the straddle 120 is moved out of the wellbore 100 by spooling in the wireline 40 from the winch unit 50. The combined string is moved into the sluice 70 for isolation from the wellbore and sluicing. The sluice 70 is disconnected from the wellhead 101, and with the combined string contained therein, is hoisted onto the intervention vessel 60 for retrieval. The tool string 10 and the recovered straddle 120 can then be safely removed to complete the removal operation.

With reference to FIG. 6, the configuration of the tool string 10 with the GS-pulling tool 14 in position for engagement with the straddle 120 is shown in further detail. As can be seen, the tractor 15 and casing collar locator 16 are positioned within the straddle 120, and the GS-pulling tool 14 is pulled by the tractor 15 adjacent to an end portion of the straddle 120. In this position, the GS-pulling tool 14 can engage interlockingly with the straddle 120 as described above. The straddle 120 is shown in its original installed position within a section of well tubing 103 within the wellbore 100.

The embodiments described can provide advantages in that the overall length of the combined tool string and equipment can be significantly reduced over previous techniques through the arrangement and use of the tool string 10 as described above. This can be achieved without needing to increase sluice length or the tool string length over prior art techniques. A greater number of well operations for removing equipment from a well using the tool string may then be feasible, and/or operations may be performed more cost effectively. The benefits of the invention can be obtained by making use of existing tools, without requiring wholescale re-design of tool string components.

Various modifications and improvements may be made without departing from the scope of the invention herein described.

The invention claimed is:

1. A method of removing equipment from a section of a wellbore, the method comprising the steps of:

(a) providing a tool string comprising a tractor and an engaging tool;

(b) running the tool string into the wellbore in a running-in direction using the tractor at least one section of which is positioned in the tool string ahead of the engaging tool in the running-in direction; and (c) using the engaging tool to couple the equipment to the tool string to allow the equipment to be removed.

2. The method as claimed in claim 1, wherein the equipment to be removed comprises a tubular structure and the method further comprises moving said section of the tractor into the tubular structure in order to position the engaging tool.

3. The method as claimed in claim 2, wherein the tubular structure comprises a straddle.

4. The method as claimed in claim 1, wherein the engaging tool comprises a GS-pulling tool.

5. The method as claimed in claim 1, further pulling out a coupled tool string and equipment from the wellbore.

6. The method as claimed in claim 5, further pulling the tool string out by spooling in a flexible elongate member coupled to the tool string.

7. The method as claimed in claim 5, locating the coupled tool string and equipment in a sluice.

8. The method as claimed in claim 7, wherein the sluice is arranged on a well head.

9. The method as claimed in claim 1, wherein the tool string further comprises any one or more selected from the group consisting of: an actuator for activating the engaging tool and/or dislodging the equipment to be removed; a locator device for use in determining the position of the tool string within the wellbore; a connecting head for attaching the tool string to a flexible elongate member; a release device for emergency disconnect; and a swivel for limiting torque on the flexible elongate member.

10. The method as claimed in claim 1, wherein the tool string has a casing collar locator arranged ahead of the engaging tool in the running-in direction.

11. The method as claimed in claim 1, wherein said at least one section of the tractor comprises at least one drive wheel for propelling the tool string along the wellbore.

12. The method as claimed in claim 1, wherein the tractor is arranged within the tool string entirely ahead of the engaging tool in the running-in direction.

13. A tool string for removing equipment from a section of the wellbore, the tool string having a first end and a second end, the tool string being configured to be connected to a flexible elongate member at the first end, the tool string comprising:

pulling tool configured to couple the equipment to the tool string in the wellbore;

a stroker operable to help to dislodge the equipment when coupled by the pulling tool to allow the equipment to be removed; and a tractor at least one section of which has a position along the tool string ahead of the pulling tool in a direction toward the second end.

14. The tool string according to claim 13, wherein the pulling tool is configured to communicate electrical energy between an electrical supply and the section of the tractor positioned ahead of the pulling tool in the direction toward the second end, the electrical energy to operate the tractor.

15. The tool string according to claim 13, wherein the pulling tool is a GS-pulling tool.

* * * * *